US011650523B2

(12) United States Patent
Asami et al.

(10) Patent No.: US 11,650,523 B2
(45) Date of Patent: May 16, 2023

(54) IMAGE FORMING APPARATUS INCLUDING A TRANSFER MEMBER WITH A ROTATABLE CONDUCTIVE SHAFT HAVING A VOID AND HAVING AN ELASTIC PORTION WHICH COVERS A PERIPHERY OF THE SHAFT

(71) Applicant: CANON KABUSHIKI KAISHA, Tokyo (JP)

(72) Inventors: Jun Asami, Shizuoka (JP); Taisuke Minagawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/492,443

(22) Filed: Oct. 1, 2021

(65) Prior Publication Data

US 2022/0113658 A1 Apr. 14, 2022

(30) Foreign Application Priority Data

Oct. 9, 2020 (JP) ..... JP2020-171283

(51) Int. Cl.
*G03G 15/16* (2006.01)

(52) U.S. Cl.
CPC ..... *G03G 15/1685* (2013.01); *G03G 15/1675* (2013.01)

(58) Field of Classification Search
CPC ..... G03G 15/1675; G03G 15/1685
See application file for complete search history.

(56) References Cited

U.S. PATENT DOCUMENTS

2016/0231668 A1* 8/2016 Furukawa ..... G03G 15/1685

FOREIGN PATENT DOCUMENTS

| | | | |
|---|---|---|---|
| JP | 10268671 | A | 10/1998 |
| JP | 2005062746 | A | 3/2005 |
| JP | 2013097065 | A | 5/2013 |

OTHER PUBLICATIONS

Oba et al. (JP2005062746A)—English translation of the "Detailed Description".*

* cited by examiner

*Primary Examiner* — Joseph S Wong
(74) *Attorney, Agent, or Firm* — Canon U.S.A., Inc. I.P. Division

(57) ABSTRACT

In a case where a transfer roller is viewed from a direction orthogonal to a rotation axis direction of a shaft, the shaft includes in a longitudinal direction a first contact portion which is provided on an end portion side of an elastic portion and in which the shaft and the elastic portion are in contact with each other and a second contact portion which is provided on a more inner side than the first contact portion and in which the shaft and the elastic portion are in contact with each other. The transfer roller includes a void between the first contact portion and the second contact portion in the longitudinal direction, and the void is arranged at least on a more inner side than an end portion of a transfer material having a maximum size.

7 Claims, 12 Drawing Sheets

IMAGE FORMING APPARATUS INCLUDING A TRANSFER MEMBER WITH A ROTATABLE CONDUCTIVE SHAFT HAVING A VOID AND HAVING AN ELASTIC PORTION WHICH COVERS A PERIPHERY OF THE SHAFT

BACKGROUND

Field of the Disclosure

The present disclosure relates to an image forming apparatus performing an electrophotographic method such as a laser printer, a copying machine, or a facsimile.

Description of the Related Art

A conventional image forming apparatus adopting an electrophotographic method includes a drum-shaped electrophotographic photosensitive member (hereinbelow, referred to as a photosensitive member) for bearing a toner image and forms an image on a transfer material such as paper or an overhead projector (OHP) sheet via a charge process, an exposure process, a development process, a transfer process, and a fixing process. In the transfer process, the image forming apparatus electrostatically transfers the toner image from the photosensitive member to the transfer material by applying a voltage to a transfer member facing the photosensitive member. In recent image forming apparatuses, contact type transfer members which come into contact with photosensitive members are often used, and generation of ozone can be suppressed by adopting the contact type transfer member.

In a case where the contact type transfer member is used, at the time of transferring a toner image from a photosensitive member to a transfer material sandwiched between the photosensitive member and a transfer member, a current is concentrated and flows in an end portion at which the transfer material does not intervene in a width direction of the transfer material orthogonal to a conveyance direction of the transfer material in some cases. This is because a resistance is higher in a position in which the transfer material intervenes than in a position in which the transfer material does not intervene in an area in which the photosensitive member and the transfer member face each other in the width direction of the transfer material. If the current is concentrated in the end portion in which the transfer material does not intervene, an electrostatic history is generated at an end portion of the photosensitive member during the transfer process, which makes it easier for toner to excessively adhere to the end portion of the photosensitive member, and there is a risk that an end portion of the transfer material is soiled during image forming.

According to Japanese Patent Application Laid-Open No. 10-268671, a contact type transfer member is discussed which is configured with a conductive shaft and a semiconductive member surrounding the conductive shaft. According to Japanese Patent Application Laid-Open No. 10-268671, a high resistance member is provided between the conductive shaft and the semiconductive member at an end portion of a transfer member in a width direction of a transfer material in order to suppress occurrence of the above-described soiling in the end portion.

In a configuration of the transfer member in which the high resistance member is provided between the conductive shaft and the semiconductive member as discussed in Japanese Patent Application Laid-Open No. 10-268671, there is a concern that a manufacturing process of the transfer member is complicated because the high resistance member is provided.

SUMMARY

The present disclosure provides for a contact type transfer member which is used in an image forming apparatus and can suppress occurrence of soiling in an end portion in a width direction of a transfer material.

According to an aspect of the present disclosure, an image forming apparatus includes an image bearing member configured to bear a toner image, and a transfer member configured to transfer the toner image born by the image bearing member to a transfer material in a transfer portion which faces the image bearing member, the transfer member comprising a rotatable conductive shaft and an elastic portion which covers a periphery of the shaft, wherein, when the shaft is viewed from a direction orthogonal to a rotation axis direction of the shaft, the shaft includes a first contact portion which is provided on an end portion side of the elastic portion in the rotation axis direction and in which the shaft and the elastic portion are in contact with each other and a second contact portion which is provided on a more center side of the transfer portion than the first contact portion in the rotation axis direction and in which the shaft and the elastic portion are in contact with each other, the first contact portion is provided on a more end portion side of the elastic portion than an end portion of a transfer material having a maximum size which can pass through the transfer portion, the transfer member includes a void between the first contact portion and the second contact portion in the rotation axis direction, and the void is arranged on a more center side of the transfer portion than the end portion of the transfer material having the maximum size.

Further features of the present disclosure will become apparent from the following description of exemplary embodiments with reference to the attached drawings.

DESCRIPTION OF THE EMBODIMENTS

Various exemplary embodiments of the present disclosure will be described below with reference to the attached drawings. However, components described in the following exemplary embodiments can be appropriately modified in their dimensions, materials, shapes, and relative arrangement considering the configuration and various conditions of an apparatus to which the present disclosure is applied, and they are not to be construed as intended to restrict the scope of the present disclosure.

[Image Forming Apparatus]

Figure 1:
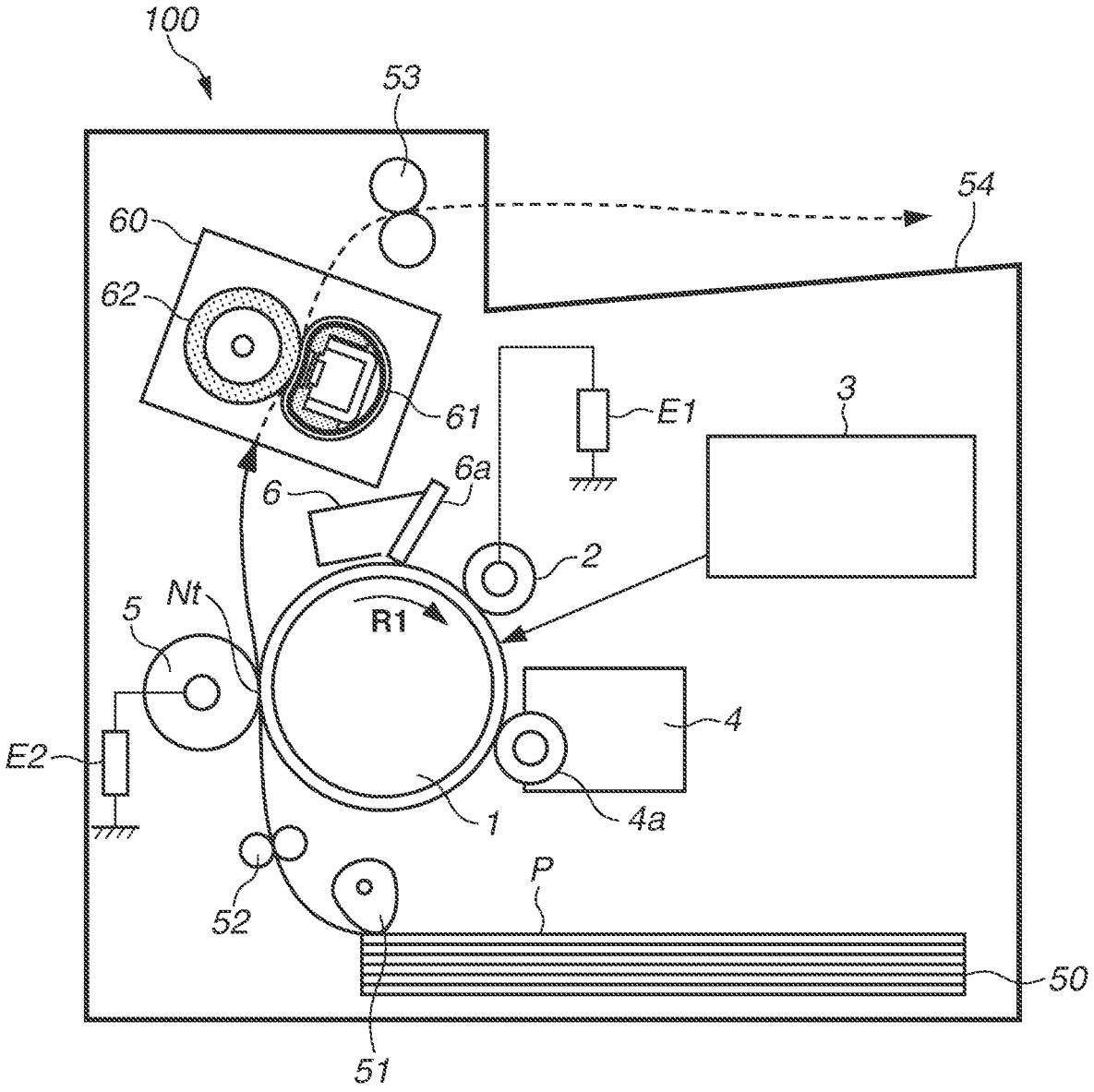
FIG. 1 is a schematic cross-sectional view of a configuration of an image forming apparatus.

FIG. 1 is a schematic cross-sectional view of a configuration of an image forming apparatus 100 according to a first exemplary embodiment. As illustrated in FIG. 1, the image forming apparatus 100 according to the present exemplary embodiment includes a photosensitive drum 1 (an image bearing member) which is a drum-shaped photosensitive member, and the photosensitive drum 1 is rotationally driven at a predetermined circumferential speed in a direction of an arrow R1 in FIG. 1 by receiving a driving force from a non-illustrated driving source. Further, a charging roller 2 as a charging member, an exposure unit 3, a development unit 4 including a development roller 4*a* as a development member, and a cleaning unit 6 including a cleaning blade 6*a* are arranged in a periphery of the photosensitive drum 1.

The charging roller 2 abuts on and can charge the photosensitive drum 1 to a uniform potential (approximately −600 V according to the present exemplary embodiment) by being applied with a voltage from a charging power supply E1. The development unit 4 stores toner, and the development roller 4*a* is applied with a voltage having a polarity opposite to a normal charge polarity of the toner from a non-illustrated development power supply and thus can bear the toner stored in the development unit 4

A transfer roller 5 as a contact type transfer member which forms a transfer portion Nt by coming into contact with the photosensitive drum 1 is arranged at a position facing the photosensitive drum 1. The transfer roller 5 includes a core metal and an elastic member such as rubber which is conductive and is formed on a surface of the core metal, and is connected to a transfer power supply E2. A configuration of the transfer roller 5 according to the present exemplary embodiment is described in detail below.

In a conveyance direction of a transfer material P, a sheet feeding cassette 50 which stores the transfer material P such as paper or an overhead projector (OHP) sheet, a feeding unit 51 which feeds the transfer material P stored in the sheet feeding cassette 50 to the transfer portion Nt, and a conveyance roller 52 as a conveyance member are arranged on an upstream side of the transfer portion Nt.

A fixing unit 60 including a heating member 61 and a pressing member 62 is arranged on a downstream side of the transfer portion Nt in the conveyance direction of the transfer material P. Further, a sheet discharge tray 54 which loads the transfer material P on which an image is formed and which is discharged from the image forming apparatus 100 thereon and a sheet discharge roller 53 which discharges the transfer material P to the sheet discharge tray 54 are arranged on the downstream side of the fixing unit 60.

If a controller circuit (not illustrated) receives an image signal, and an image forming operation is started, the photosensitive drum 1 is rotationally driven and uniformly charged to a predetermined potential by the charging roller 2 which is applied with a voltage having a predetermined polarity (a negative polarity according to the present exemplary embodiment) in a rotation process. Then, an electrostatic latent image corresponding to a target image is formed on a surface of the photosensitive drum 1 by being subjected to exposure according to the image signal by the exposure unit 3. The electrostatic latent image is developed at a development position by the development roller 4*a* bearing the toner and is visualized as a toner image by the photosensitive drum 1. According to the present exemplary embodiment, the normal charge polarity of the toner stored in the development unit 4 is the negative polarity, and reversal development is performed on the electrostatic latent image with the toner charged to a polarity same as the charge polarity of the photosensitive drum 1 by the charging roller 2. However, the present disclosure can also be applied to an image forming apparatus which positively develops an electrostatic latent image with toner charged in a polarity opposite to the charge polarity of the photosensitive drum 1 without being limited to the above-described configuration.

A voltage having a polarity (the positive polarity according to the present exemplary embodiment) opposite to the normal charge polarity of the toner is applied from the transfer power supply E2 to the transfer roller 5 (the transfer member), and thus the toner image formed on the photosensitive drum 1 is transferred to the transfer material P fed from the sheet feeding cassette 50 at the transfer portion Nt. The transfer roller 5 is urged toward the photosensitive drum 1 by a non-illustrated urging unit and is rotated by following rotation of the photosensitive drum 1 at the time when the toner image is transferred from the photosensitive drum 1 to the transfer material P.

The transfer material P on which the toner image is transferred from the photosensitive drum 1 in the transfer portion Nt is conveyed to the fixing unit 60 along a path indicated by a dotted arrow in FIG. 1 and is heated and pressed in the fixing unit 60, so that the toner image is fixed. Subsequently, the transfer material P on which the toner image is fixed is discharged from the image forming apparatus 100 by the sheet discharge roller 53 and is stacked on the sheet discharge tray 54. The toner remaining on the photosensitive drum 1 after the toner image is transferred from the photosensitive drum 1 to the transfer material P is collected to the cleaning unit 6 by the cleaning blade 6*a* arranged on the downstream side of the transfer portion Nt in a rotation direction of the photosensitive drum 1. The image forming apparatus 100 according to the present exemplary embodiment forms an image on the transfer material P by the above-described operations.

Figure 2:
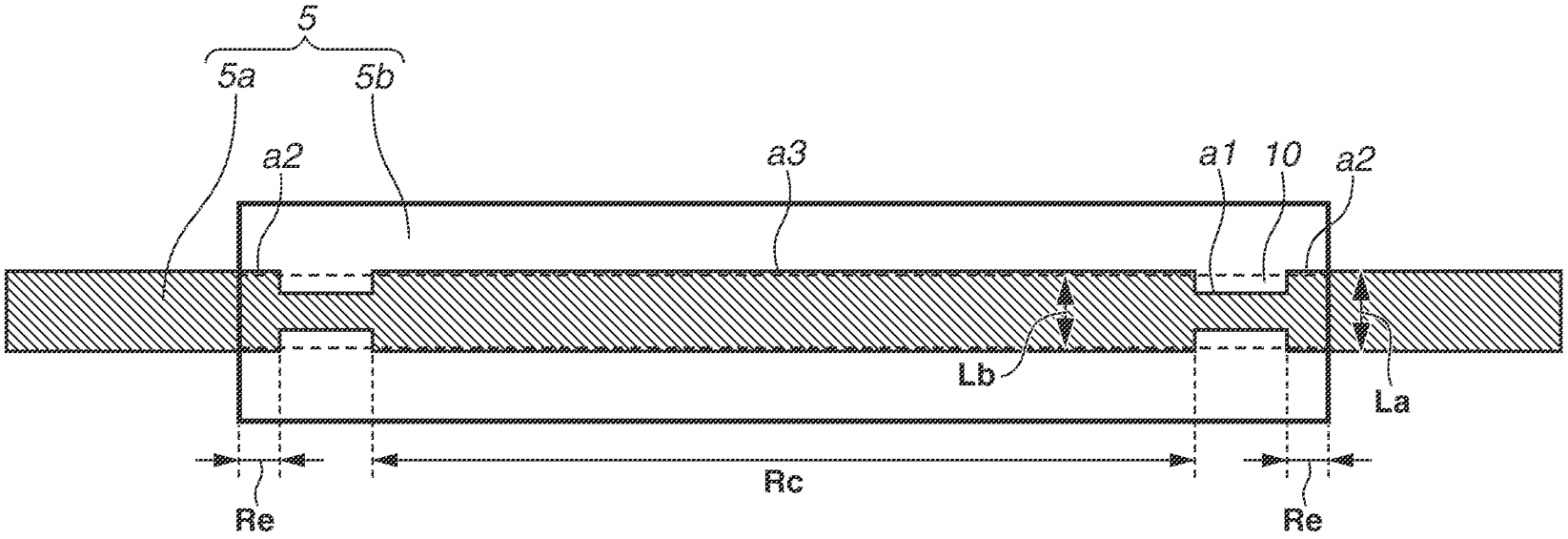
FIG. 2 is a schematic diagram of a configuration of a transfer roller according to a first exemplary embodiment.

FIG. 2 is a schematic diagram of a configuration of the transfer roller 5 as the transfer member viewed from a direction orthogonal to a rotation axis direction of the photosensitive drum 1 and the transfer roller 5 in FIG. 1. In the following descriptions, a direction orthogonal to the conveyance direction of the transfer material P or the rotation axis direction of the transfer roller 5 in the image forming apparatus 100 is referred to as a longitudinal direction.

As illustrated in FIG. 2, the transfer roller 5 is configured with a shaft 5*a* having conductivity, surrounded by an elastic portion 5*b* which is a tube-shaped semiconductive member. The conductive shaft 5*a* is made of a metal material such as stainless steel (SUS), a conductive resin, or the like, and an outer diameter La of the shaft 5*a* is larger than an inner diameter Lb of the tube-shaped elastic portion 5*b*. In the transfer roller 5, the shaft 5*a* and the elastic portion 5*b* are mechanically fixed to each other without using an adhesive by pressing and fitting the shaft 5*a* having the outer diameter La larger than the inner diameter Lb of the elastic portion 5*b* into the elastic portion 5*b*. According to the present exemplary embodiment, the transfer roller 5 is formed by pressing and fitting the shaft 5*a* into the elastic portion 5*b*. However, without being limited to the above-described configuration, the conductive shaft 5*a* to which a conductive thermosetting adhesive is applied may be bonded to the elastic portion 5*b* to enhance adhesiveness.

As illustrated in FIG. 2, the shaft 5*a* includes a concave portion a1 which has a predetermined width and a shape concaved inward in a radial direction of the shaft 5*a* and is arranged near both end portions of the elastic portion 5*b* when viewed from a direction orthogonal to the rotation axis direction of the shaft 5*a*. The concave portions a1 are provided inside both end portions of the elastic portion 5*b*, and first contact portions a2 in which the shaft 5*a* and the elastic portion 5*b* are in contact with each other are arranged on both end sides of the elastic portion 5*b*. A second contact portion a3 in which the shaft 5*a* and the elastic portion 5*b* are in contact with each other is provided on a more center side than the concave portion a1 (namely, a more inner side than the concave portions a1) in the rotation axis direction of the shaft 5*a*. A region in which the first contact portion a2 is provided and a region in which the second contact portion a3 is provided are respectively referred to as a first region Re and a second region Rc. The transfer roller 5 includes the concave portion a1, and thus a void 10 in which the elastic portion 5*b* and the shaft 5*a* are not in contact with each other is formed between the first contact portion a2 and the second contact portion a3 near an area in which the transfer material P passes through the transfer portion Nt (hereinbelow, referred to as a sheet passing area).

The elastic portion 5*b* as a semiconductive member according to the present exemplary embodiment includes rubber, a cross-linking component for cross-linking the rubber, a foaming component for foaming the rubber, and potassium salt of an anion including a fluoro group and a sulfonyl group in a molecule. The rubber includes conductive rubber composition including at least one selected from a group including styrene-butadiene rubber (SBR) and nitrile-butadiene rubber (NBR) and epichlorohydrin rubber.

A manufacturing method of the transfer roller 5 according to the present exemplary embodiment is as follows. First, an adjusted conductive rubber composition is continuously extruded into a tube shape through a mouthpiece of a head of an extrusion machine, and the extruded tube passes through a microwave cross-linking device and then a hot air cross-linking device without being cut. Accordingly, the conductive rubber composition is continuously foamed and cross-linked to form a tube-shaped foam. Then, the tube-shaped foam is cut to a predetermined length. A conductive shaft (the shaft 5*a*) is inserted into the obtained tube-shaped foam having the predetermined length (the elastic portion 5*b*) and cooled, and then an outer circumferential surface of the tube-shaped foam is polished to be a predetermined outer diameter. Accordingly, the transfer roller 5 is obtained. As a polishing method for the elastic portion 5*b*, various polishing methods such as dry traverse polishing can be adopted.

The transfer roller 5 according to the present exemplary embodiment is a conductive roller having an outer diameter of 14.0 mm which is configured with the conductive shaft 5*a* having an outer diameter of 5 mm and the elastic portion 5*b* as the semiconductive member having a thickness of 4.5 mm. A longitudinal width (a width in the rotation axis direction) of the elastic portion 5*b* is set to 216 mm which is the same as a width of a letter (LTR) size sheet which is a maximum size transfer material P that can be used in the image forming apparatus 100. Further, an electric resistance value of the transfer roller 5 is a resistance value calculated from a current value measured by applying a voltage of 2.0 KV to the conductive shaft 5*a* and is approximately $5.0*10^7\Omega$. The electric resistance value of the transfer roller 5 was measured by rotating the transfer roller 5 at a circumferential speed of approximately 120 mm/sec in a state in which the transfer roller 5 was pressed against a grounded aluminum drum with a load of 400 g under a normal temperature and humidity environment.

Figure 3:
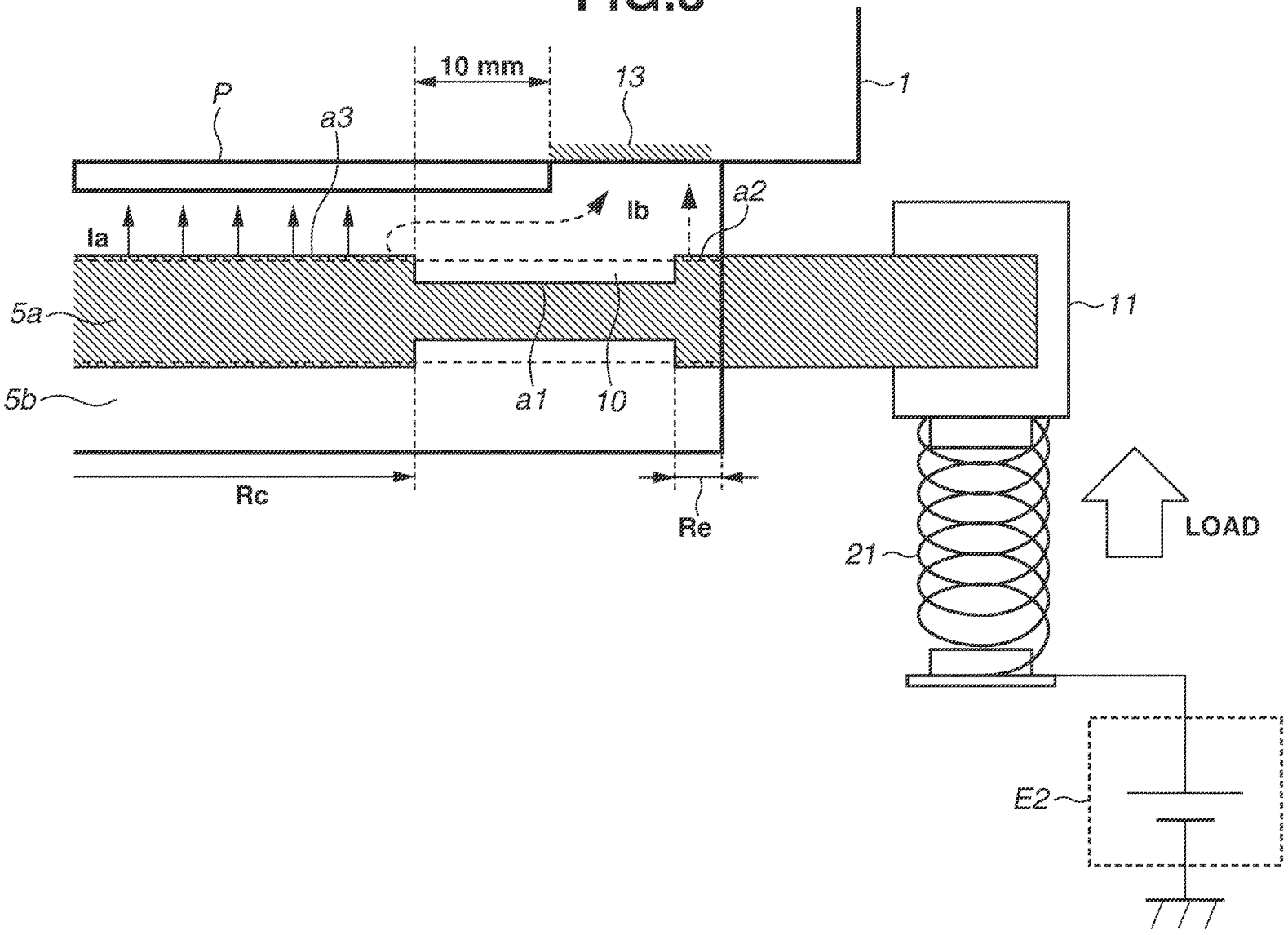
FIG. 3 is a schematic diagram of a transfer configuration according to the first exemplary embodiment.

FIG. 3 is an enlarged schematic diagram of one end side in the longitudinal direction of a transfer device using the transfer roller 5. The transfer roller 5 is held by a bearing unit 11 at the end portions of the shaft 5*a* and pressed by a transfer spring 21 against the photosensitive drum 1 with a load of a total pressure of approximately 2.0 Kgf (1.0 Kgf on one side). Further, the transfer roller 5 is applied with a predetermined voltage from the transfer power supply E2 via the transfer spring 21 and the bearing unit 11 in the pressed state.

The voltage is applied as described above, and thus a current necessary for transferring the toner image flows from the second contact portion a3 on the shaft 5*a* of the transfer roller 5 toward the photosensitive drum 1 via the elastic portion 5*b* and the transfer material P through paths Ia illustrated by solid arrows in FIG. 3. At that time, a part of the current flowing from the shaft 5*a* toward the photosensitive drum 1 flows in a path Ib indicated by a dotted arrow in FIG. 3 from the first contact portion a2 toward a non-sheet passing area 13 at which the elastic portion 5*b* and the photosensitive drum 1 are in direct contact with each other.

The non-sheet passing area is an area in which the elastic portion 5*b* and the photosensitive drum 1 are in direct contact with each other without intervention of the transfer material P in the longitudinal direction. If an excessive current flows into the non-sheet passing area 13, the surface of the photosensitive drum 1 in the non-sheet passing area 13 is charged, and a local electrostatic history (hereinbelow, referred to as a transfer memory) is formed on the photosensitive drum 1 after transfer. In a case where the transfer memory is formed on the photosensitive drum 1, charging becomes insufficient in a position at which the transfer memory is generated on the surface of the photosensitive drum 1 in the charge process in a next image forming operation, and thus the toner adheres to the position. Then, in a case where a position of the transfer material P in the longitudinal direction is deviated even a little in the transfer process, toner unrelated to an image to be originally formed adheres to the end portion of the transfer material P and causes an image defect (hereinbelow, referred to as end portion soiling).

Therefore, according to the present exemplary embodiment, the concave portion a1 is formed on the shaft 5*a* of the transfer roller 5 in order to suppress the current from flowing into the non-sheet passing area 13 of the photosensitive drum 1. A width of the concave portion a1 is secured from the first contact portion a2 between the elastic portion 5*b* and the shaft 5*a* in the first region Re to a more inner side than the end portion of the transfer material P in the sheet passing area in the longitudinal direction. The reason is described below. According to the present exemplary embodiment, the concave portion a1 is formed from the end portion of an A4 size transfer material P to the inside of the sheet passing area by about 10 mm within a range in which transfer property of the toner image can be ensured at the end portion of the transfer material P. Further, a depth of the concave portion a1 is approximately 0.5 mm in the radial direction of the shaft 5*a*.

The shaft 5*a* arranged in the first region Re, namely the first contact portion a2 of the shaft 5*a* which is in contact with an inner circumferential surface of the elastic portion 5*b* on an end portion side of the elastic portion 5*b* in the longitudinal direction serves as a pillar for supporting the elastic portion 5*b* at both ends. A width of the first contact portion a2 in the first region Re in the longitudinal direction is set to about 2 mm according to the present exemplary embodiment as a minimum width necessary for fulfilling the function of the pillar. Accordingly, in a case where the transfer roller 5 is urged toward the photosensitive drum 1, the void 10 is formed without contact between an inside (the inner circumferential surface) of the elastic portion 5*b* and the shaft 5*a*, and the amount of current flowing from the shaft 5*a* toward the non-sheet passing area 13 in the first region Re is suppressed to a minimum.

As described above, the current flowing into the non-sheet passing area 13 of the photosensitive drum 1 can be suppressed by forming the void 10 between the shaft 5*a* and the elastic portion 5*b* on the end portion side of the elastic portion 5*b* in the longitudinal direction on the shaft 5*a* in which the concave portion a1 is formed.

Figure 4:
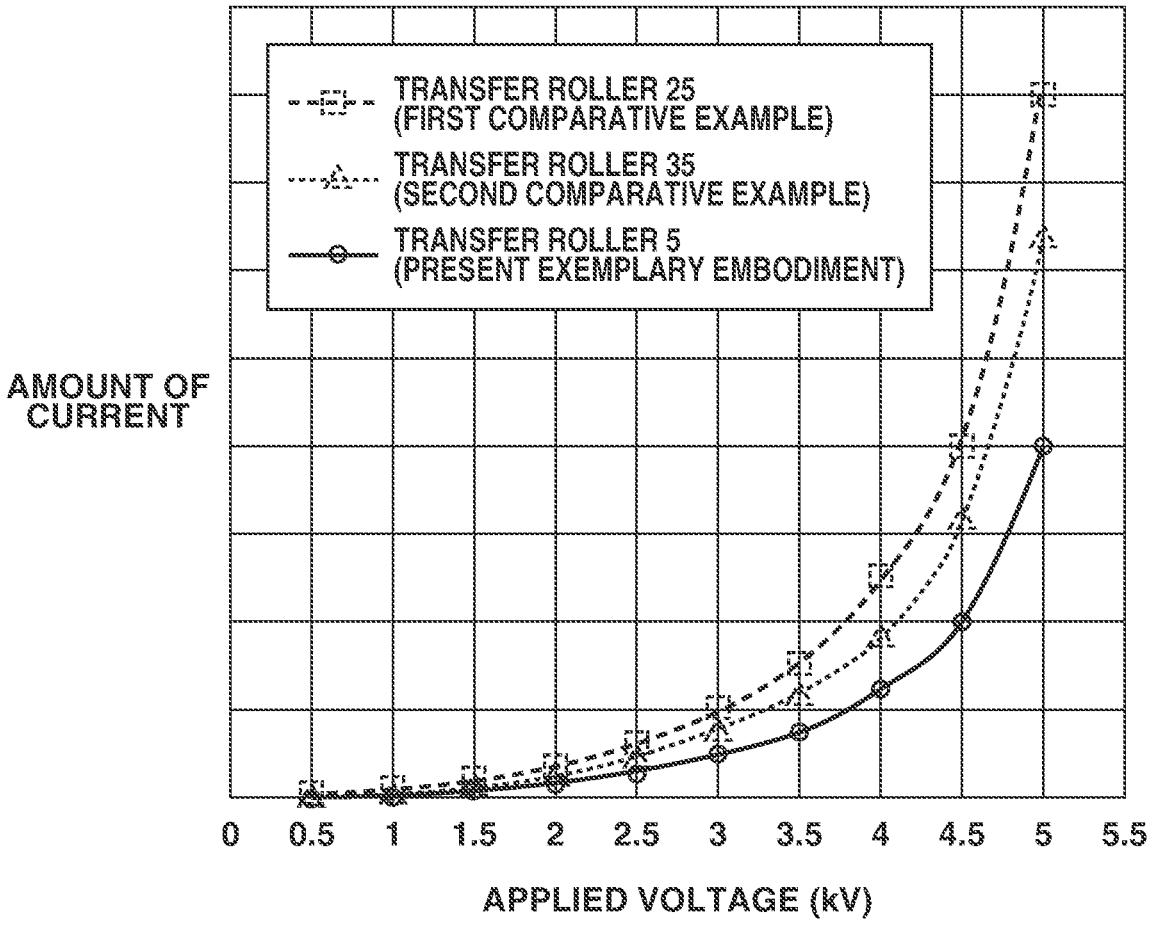
FIG. 4 is a graph illustrating a relationship between an amount of current flowing to a non-sheet passing area and an applied voltage.
Figure 5:
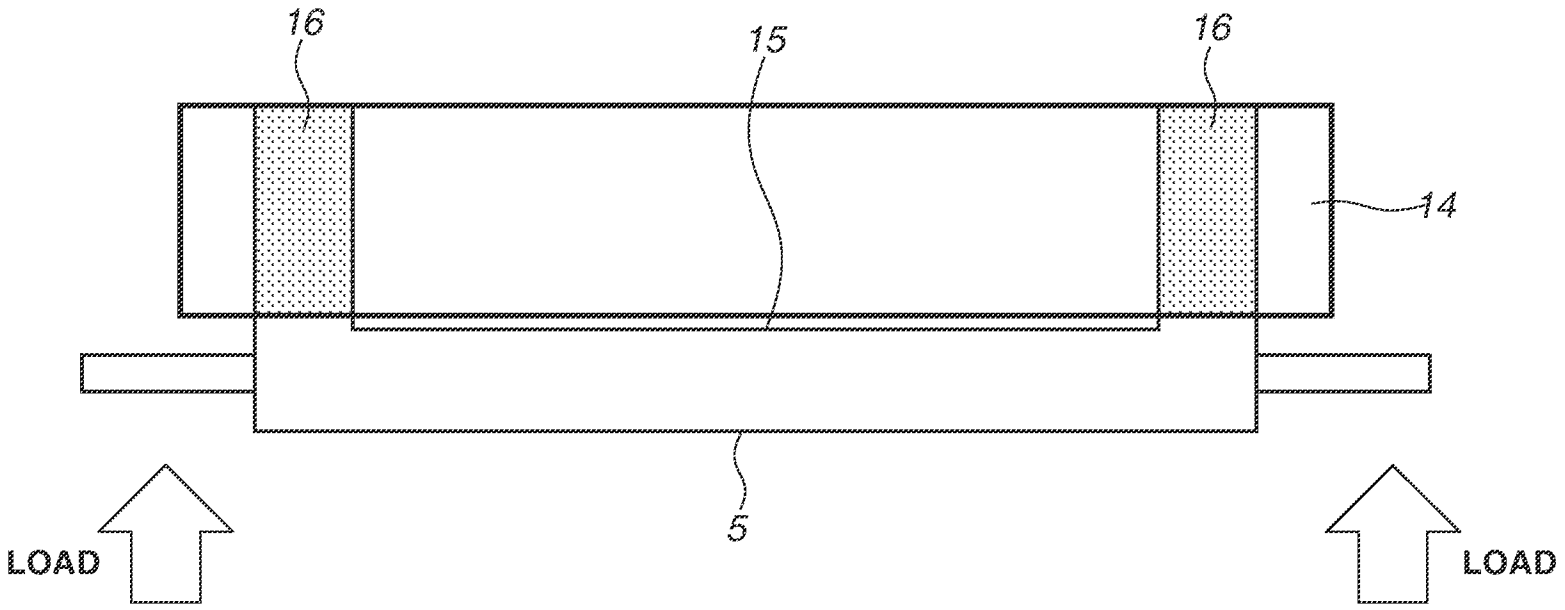
FIG. 5 is a schematic diagram of a configuration of a jig used in measurement of an amount of current flowing to the non-sheet passing area.
Figure 6:
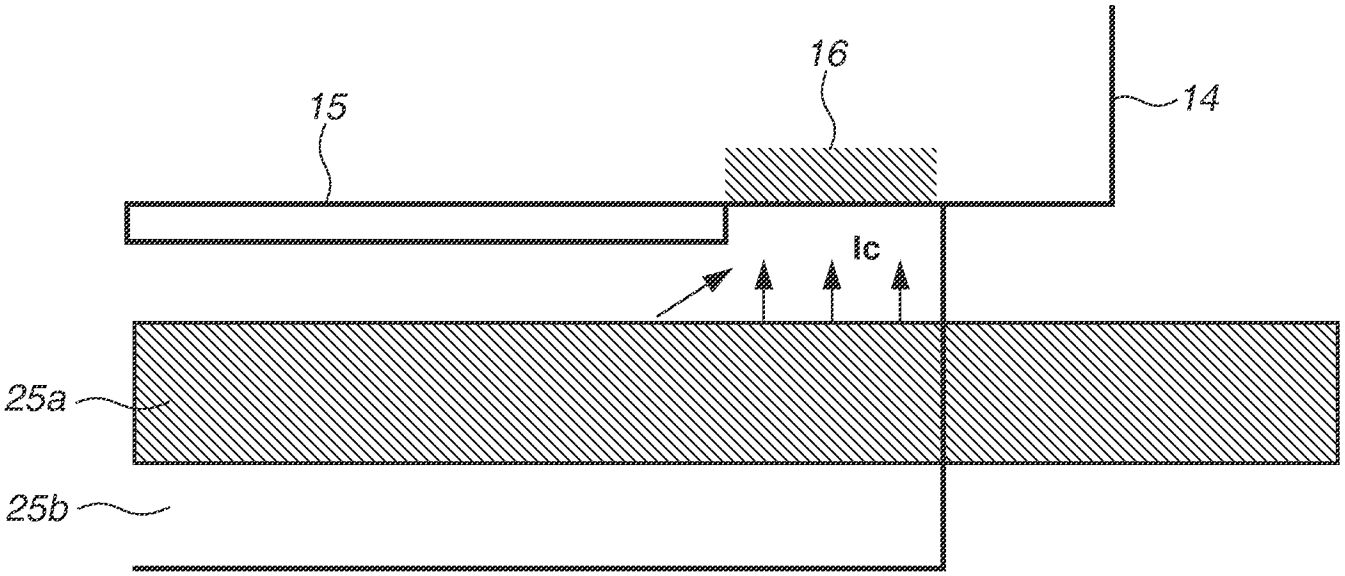
FIG. 6 is a schematic diagram of a configuration and a path of a current flowing to a non-sheet passing area according to a first comparative example.
Figure 7:
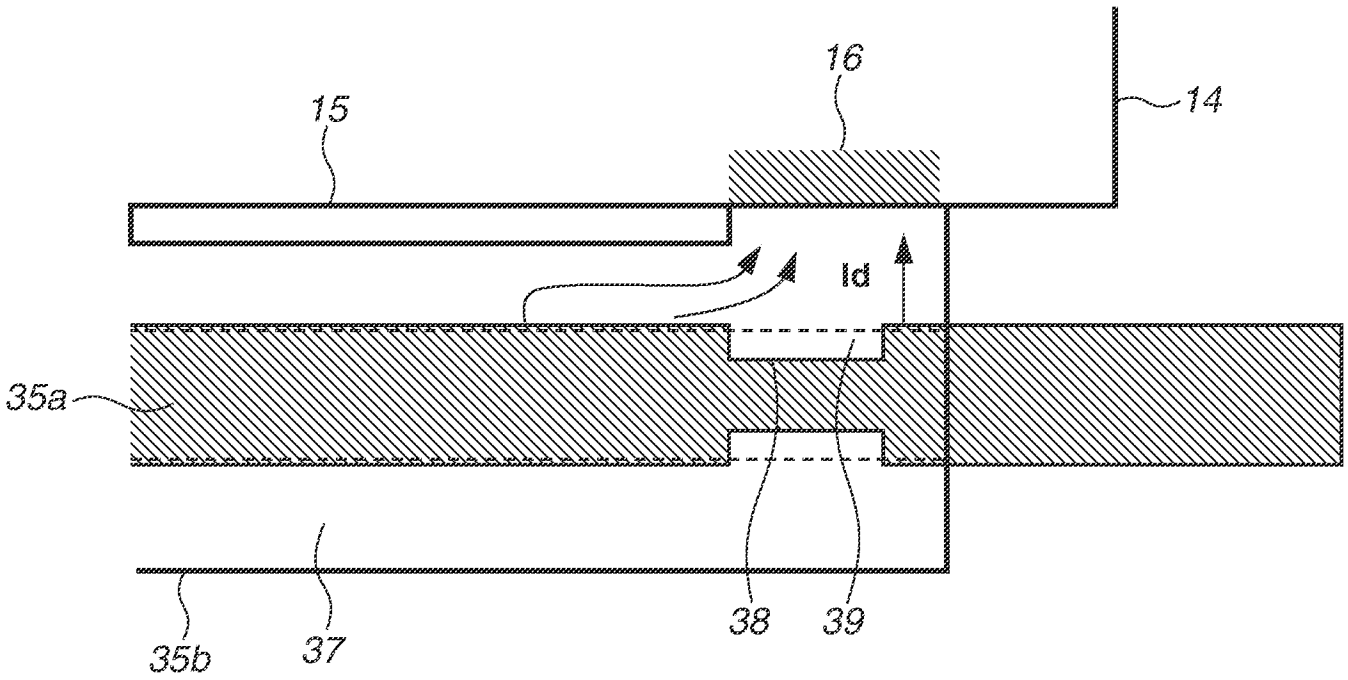
FIG. 7 is a schematic diagram of a configuration and a path of a current flowing to a non-sheet passing area according to a second comparative example.

FIG. 4 illustrates measurement results of the amount of current flowing to the non-sheet passing area 13 in a case where an image is formed on an A4 size transfer material P using each of the transfer roller 5 according to the present exemplary embodiment, a transfer roller 25 according to a first comparative example, and a transfer roller 35 according to a second comparative example. FIG. 5 is a schematic diagram of a jig used in the measurement of the amount of current flowing to the non-sheet passing area 13. Further, FIGS. 6 and 7 are respective schematic diagrams illustrating a configuration of the transfer roller 25 according to the first comparative example and a configuration of the transfer roller 35 according to the second comparative example.

Regarding the transfer roller 25 according to the first comparative example and the transfer roller 35 according to the second comparative example, widths in the longitudinal direction, electric resistance values, and materials of the elastic portions are the same as those according to the present exemplary embodiment, and only shapes of the shafts of the transfer rollers are different from the present exemplary embodiment. The configurations of the transfer rollers 25 and 35 according to the respective first and second comparative examples are described in details below.

As illustrated in FIG. 4, it can be seen that the current flowing to the non-sheet passing area 13 at the same applied voltage is suppressed by using the transfer roller 5 according to the present exemplary embodiment as compared with the configurations of the first and the second comparative examples. The details are described below.

The current flowing to the non-sheet passing area 13 was measured in a state in which an A4 size insulation sheet 15 simulating a high resistance sheet was sandwiched between an aluminum drum 14 for resistance measurement and the transfer roller which was pressed against the aluminum drum 14 with a load of a total pressure of 400 g as illustrated in FIG. 5. Further, in the measurement of the current, a predetermined voltage (from 0.5 kV to 5.0 kV) was sequentially applied to the conductive shaft in a state in which the aluminum drum 14 and the transfer roller were not rotated (a stationary state), and a current flowing to an area 16 corresponding to the non-sheet passing area 13 described with reference to FIG. 3 was measured. It can be evaluated that as the current is smaller, the transfer roller has an effect of suppressing the transfer memory in the non-paper-passing area 13.

As illustrated in FIG. 6, the transfer roller 25 according to the first comparative example includes a shaft 25*a* and an elastic portion 25*b*. Meanwhile, unlike the configuration of the transfer roller 5 according to the present exemplary embodiment, the transfer roller 25 according to the first comparative example does not have a concave portion on the end portion side of the elastic portion 25*b*, in other words, does not have the void 10 according to the configuration of the present exemplary embodiment. In a case where the transfer roller 25 is used in the present measurement, the current flowing from the shaft 25*a* to the area 16 flows through paths Ic indicated by solid arrows in FIG. 6. The transfer roller 25 according to the first comparative example does not have the void 10, so that a larger amount of current flows from the shaft 25*a* to the area 16 through the paths Ic than the configuration according to the present exemplary embodiment.

As illustrated in FIG. 7, the transfer roller 35 according to the second comparative example includes a shaft 35*a*, an elastic portion 35*b*, and a concave portion 38 which is concaved in a radial direction of the shaft 35*a* on the end portion side of the elastic portion 35*b* in the longitudinal direction. Meanwhile, unlike the configuration of the transfer roller 5 according to the present exemplary embodiment, the transfer roller 35 according to the second comparative example has a void 39 which is formed by the concave portion 38 at a position not overlapping with the end portion of the insulation sheet 15 corresponding to the A4 size transfer material P in the longitudinal direction. In other words, the void 39 is formed not on the end portion side of the insulation sheet 15, but on the end portion side of the elastic portion 35*b* (namely, on a more outer side than the end portion of the insulation sheet 15) in the longitudinal direction.

In a case where the transfer roller 35 is used in the present measurement, the current flows from the shaft 35*a* to the area 16 through paths Id indicated by solid arrows in FIG. 7. In other words, a sum total of a minute current flowing from the shaft 35*a* on the end portion side of the elastic portion 35*b*, which is on a more outer side than the void 39, to the area 16 and a current flowing from the shaft 35*a* on an insulation sheet 15 side, which is on a more inner side than the void 39, to the area 16 by avoiding the insulation sheet 15 flows into the area 16 in the longitudinal direction. The amount of the above-described current is smaller than that in the configuration of the first comparative example as illustrated in FIG. 4. This is because the void 39 is formed and blocks a current path of a current which flows from the conductive shaft 35*a* to the area 16 in a shortest path.

Figure 8:
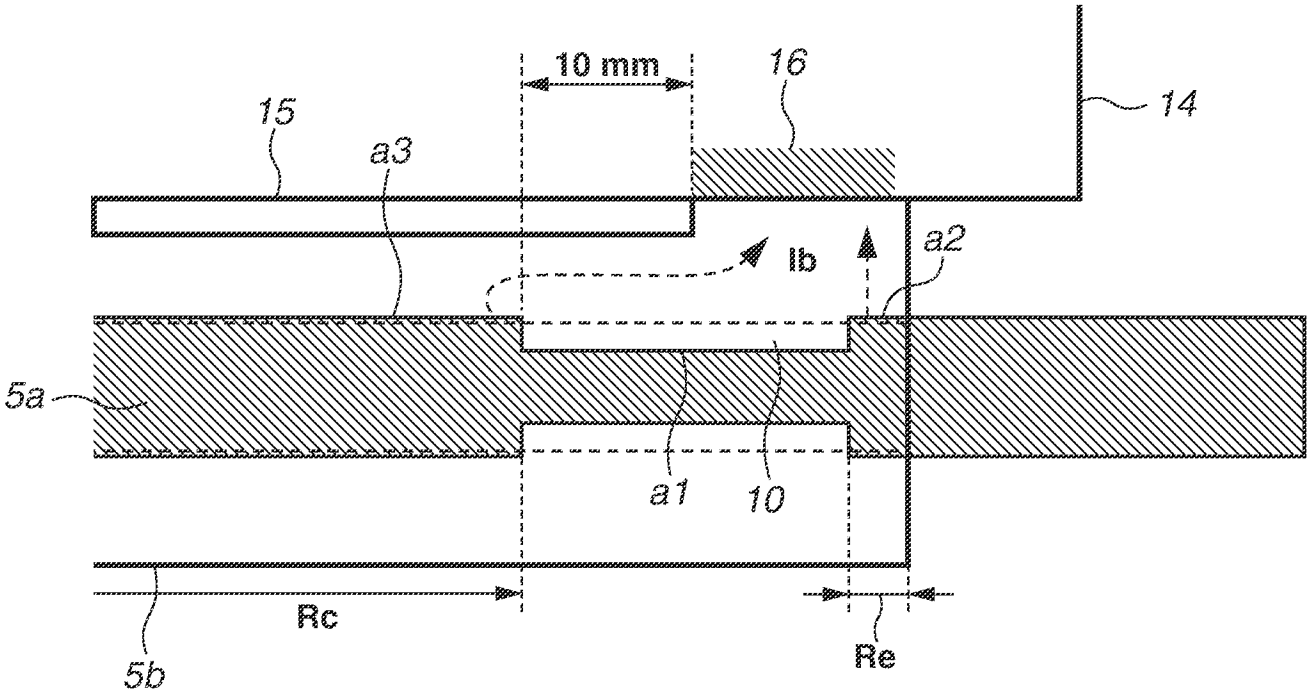
FIG. 8 is a schematic diagram of a path of a current flowing to a non-sheet passing area according to the first exemplary embodiment.

FIG. 8 is a schematic diagram of a current path of a current flowing to the area 16 in a case where the transfer roller 5 according to the first exemplary embodiment is arranged in the present measurement and a predetermined voltage is applied. The transfer roller 5 according to the present exemplary embodiment has the concave portion a1 in the shaft 5*a*, and the concave portion a1 is formed from an inner end portion of the first region Re (the end portion on a sheet passing area side) to have a length of 10 mm from the end portion of the A4 size insulation sheet 15 toward the inside in the longitudinal direction. Therefore, the amount of current flowing from the shaft 5*a* toward the area 16 is a sum of a minute current flowing from the end portion of the shaft 5*a* corresponding to the first region Re to the area 16 and a minute current flowing into the area 16 by avoiding the insulation sheet 15. As illustrated in FIG. 4, the amount of current flowing into the area 16 in a case where the transfer roller 5 according to the present exemplary embodiment is used is much smaller than that in the configuration according to the first comparative example and is also smaller than that in the configuration according to the second comparative example.

As described above, according to the present measurement, it is desirable that the shaft of the transfer roller is provided with the concave portion, and the void formed by the concave portion between the shaft and the elastic portion is provided to the inside of sheet passing area, more desirably to the inside of about 10 mm of the sheet passing area as a method for suppressing the current flowing to the non-sheet passing area. The current flowing toward the non-sheet passing area by avoiding the end portion of the transfer material P tends to be larger in a case where an electric resistance value of the transfer roller is low or in a case where a resistance value of the transfer material P is high. Therefore, in a case where various conditions are taken into consideration, it is desirable that the above-described concave portion and void are provided to the inside of the sheet passing area in the longitudinal direction as much as possible in a range in which the transfer property of the toner image at the end portion of the transfer material P can be ensured.

Table 1 indicates results of evaluating levels of the end portion soiling of the transfer materials P in a case where the A4 size transfer materials P (basis weight 68 g/m$^2$) passed using the respective transfer rollers according to the present exemplary embodiment, the first comparative example, and the second comparative example. As conditions for performing the present evaluation, an evaluation environment was set to a low temperature and low humidity environment of a room temperature of 10° C. and a humidity of 15% RH as a condition in which the end portion soiling is more likely to occur, and image forming was continuously performed on 500 sheets of the transfer materials P in a double-sided print mode. Further, in order to make a width of the non-sheet passing area uniform in the longitudinal direction for each evaluation, the transfer material P was conveyed to the transfer portion Nt in a center reference in which centers of the transfer roller and the transfer material P in the longitudinal direction are substantially in the same positions. The level of the end portion soiling was evaluated on a side of which the soiling level was worse in both end portions of the transfer material P in the longitudinal direction. In the tables below, a level A is a level at which the end portion soiling cannot be visually recognized, a level B is a level at which the end portion soiling can be visually recognized but hardly noticeable, and a level C is a level at which the end portion soiling can be clearly visually recognized.

TABLE 1

Evaluation results of end portion soiling in each configuration in a case where A4 size transfer materials p passed

| | Number of Passing Sheets Around 10 Sheets | Number of Passing Sheets Around 100 Sheets | Number of Passing Sheets Around 500 Sheets |
|---|---|---|---|
| First Comparative Example | A | B | C |

TABLE 1-continued

Evaluation results of end portion soiling in each configuration in a case where A4 size transfer materials p passed

| | Number of Passing Sheets Around 10 Sheets | Number of Passing Sheets Around 100 Sheets | Number of Passing Sheets Around 500 Sheets |
|---|---|---|---|
| Second Comparative Example | A | A | B |
| Present Exemplary Embodiment | A | A | A |

As indicated in Table 1, in the configurations according to the first and the second comparative examples, the levels of the end portion soiling increased as the number of passing sheets increased. On the other hand, according to the configuration of the present exemplary embodiment, occurrence of the end portion soiling could not be visually confirmed even if the number of passing sheets increased. This is because, the amount of current flowing into the non-sheet passing area was suppressed by providing the concave portion a1 and the void 10 associated therewith on the shaft 5*a* of the transfer roller 5 as described above.

Further, there is a tendency that the end portion soiling becomes worse as the number of continuously passing sheets increases regardless of a type of the transfer roller in Table 1. This is because the resistance of the transfer roller gradually decreased during the continuous sheet passing, and the current sneaking into the non-sheet passing area from an inside in the longitudinal direction of the A4 size sheet passing area increased. Particularly, in a case of double-sided sheet passing, the transfer material P in a high temperature state after passing through the fixing unit on a first surface passes through the transfer portion Nt again on a second side thereof. Therefore, a roller temperature significantly rises during continuous sheet passing due to repeating of the process, and the resistance value of the transfer roller tends to decrease more than that in single-sided sheet passing. In addition to the above-described decrease of the resistance value of the transfer roller, if the transfer material P having a higher resistance passes along the transfer roller, the current flowing into the non-sheet passing area is further increased. Therefore, as a method for suppressing the current flowing into the non-sheet passing area, it is desirable to provide the concave portion and the void associated therewith on the shaft of the transfer roller about 10 mm inside the sheet passing area in the longitudinal direction. It is further desirable to provide the concave portion and the void associated therewith to the inside of the sheet passing area as much as possible in the range in which the transfer property at the end portion of the transfer material P can be ensured in the longitudinal direction.

Table 2 indicates results of evaluating the levels of end portion soiling of the transfer materials P in a case where A5 size transfer materials P (basis weight 68 g/m$^2$) of which a non-sheet passing area is wider than that of the A4 size transfer material P passed using the respective transfer rollers according to the present exemplary embodiment, the first comparative example, and the second comparative example. Conditions for performing the present evaluation were set to the same as the conditions for the evaluation using the A4 size transfer material P.

TABLE 2

Evaluation results of end portion soiling in each configuration in a case where A5 size transfer materials p passed

| | Number of Passing Sheets Around 10 Sheets | Number of Passing Sheets Around 100 Sheets | Number of Passing Sheets Around 500 Sheets |
|---|---|---|---|
| First Comparative Example | A | A | B |
| Second Comparative Example | A | A | A |
| Present Exemplary Embodiment | A | A | A |

As indicated in Table 2, the levels of the end portion soiling were improved in the configurations according to the first and the second comparative examples in the case of using the A5 size transfer material P compared with the case of using the A4 size transfer material P. This is related to a fact that the A5 size transfer material P has a wider non-sheet passing area in the longitudinal direction than the A4 size transfer material P. More specifically, the non-sheet passing area is wider, so that the current flowing from the shaft provided on the sheet passing area side to the non-sheet passing area is widely dispersed in the longitudinal direction of the non-sheet passing area regardless of the configuration of the used transfer roller. In the configuration in which a width of the non-sheet passing area is narrow, it is considered that the level of the end portion soiling tends to be worse since the current is concentrated in the narrow area.

In other words, such current concentration in the non-sheet passing area is influenced by a width of the transfer material P in the longitudinal direction, a conveyance position of the transfer material P in the transfer portion Nt, a width of the elastic portion of the transfer roller in the longitudinal direction, and the like. The current concentration is remarkable in a case where the transfer material P is used which is shorter than the width of the elastic portion 5*b* of the transfer roller 5 in the longitudinal direction and has a maximum size width of which the sheet passing area is the widest. Alternatively, even if the transfer material P does not have the maximum size, the current concentration is remarkable in a case where the conveyance position of the transfer material P is shifted in the longitudinal direction, and the width of non-sheet passing area generated between the elastic portion 5*b* of the transfer roller 5 and the photosensitive drum 1 becomes narrow. In these cases, occurrence of the end portion soiling can be effectively suppressed by adopting the configuration according to the present exemplary embodiment.

As described above, according to the configuration of the present exemplary embodiment, the shaft 5*a* of the transfer roller 5 is provided with the concave portion a1, and thus the void 10 is formed between the first contact portion a2 and the second contact portion a3 in the end portion side of the elastic portion 5*b*. Further, according to the configuration of the present exemplary embodiment, at least the void 10 is formed on a more center side of the sheet passing area (namely, a more inner side than the end portion of the transfer material P) than the end portion of the transfer material P having the maximum size which can be used in the image forming apparatus 100 in the longitudinal direction. Accordingly, occurrence of the end portion soiling caused by an excessive current flowing from the transfer roller 5 toward the non-sheet passing area 13 of the photosensitive drum 1 can be suppressed.

According to the configuration of the present exemplary embodiment, the transfer roller 5 is described which is obtained by inserting the shaft 5*a* which has the concave portions a1 on both end portions into the elastic portion 5*b* which is the tube-shaped semiconductive member. Such a transfer roller 5 can be simply molded using a commonly used extrusion machine. In other words, according to the configuration of the present exemplary embodiment, occurrence of the end portion soiling can be suppressed by a simpler configuration without complicating a manufacturing process.

According to the present exemplary embodiment, an organic photosensitive drum having a laminated structure is used as an image bearing member, but the present exemplary embodiment is not limited to this configuration. As the image bearing member, a belt-shaped one or a configuration in which a latent image is written on a single layer photosensitive member, an inorganic photosensitive member, a dielectric material, or the like can be used.

Further, according to the present exemplary embodiment, the image forming apparatus 100 which transfers a toner image from the photosensitive drum 1 as the image bearing member to the transfer material P is used in the description. However, the present disclosure can also be applied to an image forming apparatus which transfers a toner image to the transfer material P via an intermediate transfer member or the like without being limited to the above-described configuration. In this case, a configuration similar to the transfer roller 5 described according to the present exemplary embodiment can be applied to a transfer member which is arranged in contact with an inner circumferential surface side of the intermediate transfer member in order to transfer a toner image from the photosensitive drum to the intermediate transfer member. In this case, at least an end portion of the intermediate transfer member is arranged to overlap with the void 10 formed by the concave portion a1 in the longitudinal direction, so that an effect similar to that according to the present exemplary embodiment can be obtained.

According to the first exemplary embodiment, the configuration is described in which the concave portion a1 having a predetermined shape is provided in the shaft 5*a* of the transfer roller 5. In contrast, according to a second exemplary embodiment, a shape of a concave portion Sal of a transfer roller 55 is different from that of the transfer roller 5 according to the first exemplary embodiment. The configuration and operations according to the second exemplary embodiment are substantially the same as those according to the first exemplary embodiment except that the concave portion Sal is different from the concave portion a1 according to the first exemplary embodiment. Therefore, in the following description, the portions common to those according to the first exemplary embodiment are denoted by the same reference numerals, and the descriptions thereof are omitted.

Figure 9:
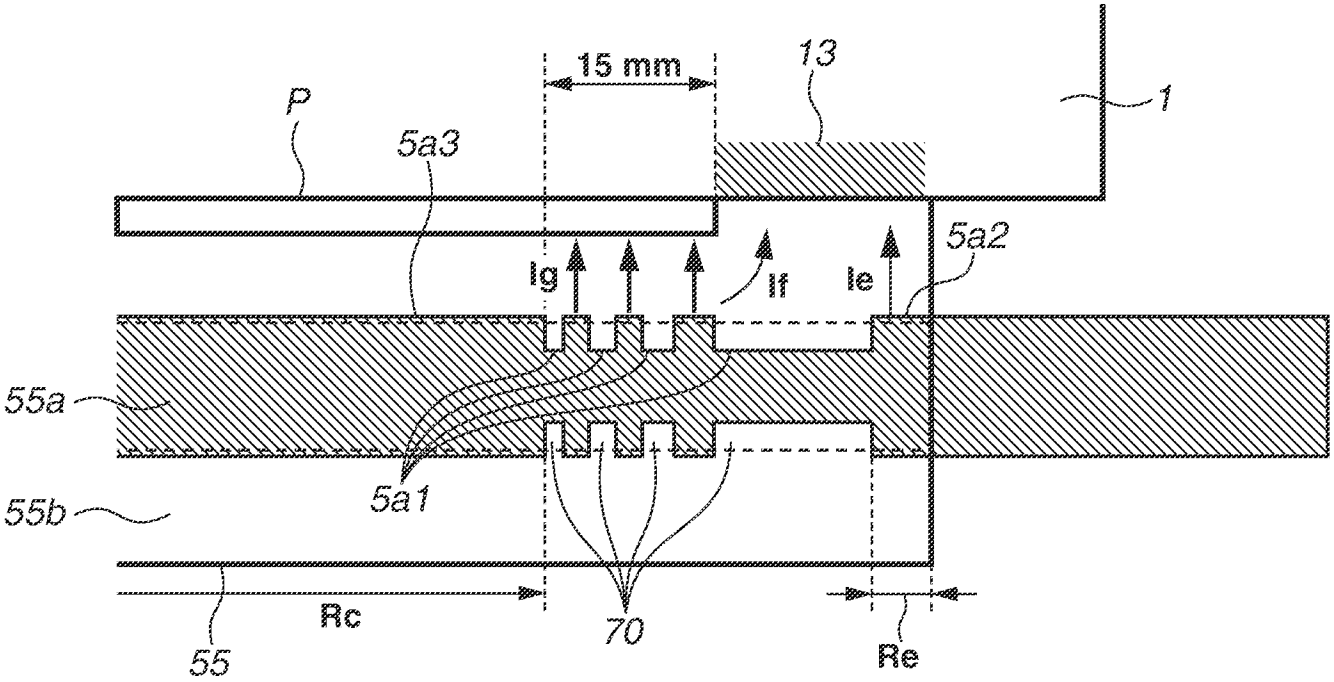
FIG. 9 is a schematic diagram of a configuration of a transfer roller and a path of a current flowing to a non-sheet passing area according to a second exemplary embodiment.

FIG. 9 is a schematic cross-sectional view of a transfer portion Nt viewed from a direction orthogonal to a rotation axis direction of the transfer roller 55 and is a schematic diagram of a configuration of the transfer roller 55 according to the present exemplary embodiment. As illustrated in FIG. 9, the transfer roller 55 includes a conductive shaft 55*a* and an elastic portion 55*b*. The shaft 55*a* is made of a metal material such as SUS, a conductive resin, or the like, and has the concave portion Sal on the end portion side of the elastic portion 55*b* in the longitudinal direction. Further, the elastic portion 55*b* is a tube-shaped semiconductive member.

The concave portion 5a1 according to the present exemplary embodiment is not a single and wide concave portion like the concave portion a1 of the transfer roller 5 according to the first exemplary embodiment, but is configured with a plurality of concave portions having different widths in the longitudinal direction. As illustrated in FIG. 9, concave portions which are concaved inward in a radial direction of the shaft 55*a* and convex portions adjacent to the concave portions are provided on a more center side of the sheet passing area (namely, a more inner side than the end portion of the transfer material P) than the end portion of the transfer material P in the longitudinal direction. With this configuration, bending of the conductive shaft 55*a* at the time when the transfer roller 55 is pressed against the photosensitive drum 1 and crushing of a void 70 which is formed between the shaft 55*a* and the elastic portion 55*b* by the concave portion Sal in the radial direction can be suppressed. In other words, according to the configuration of the transfer roller 55 of the present exemplary embodiment, the void 70 can be stably formed even in a case where a core metal diameter of the shaft 55*a* is smaller than that of the shaft 5*a* of the transfer roller 5 according to the first exemplary embodiment or in a case in which a pressure for urging the transfer roller 55 toward the photosensitive drum 1 is high.

A width of the concave portion Sal in the longitudinal direction is different in the non-sheet passing area and in the sheet passing area. The concave portion Sal corresponding directly below the non-sheet passing area 13 is formed to have a wide width in the longitudinal direction in order to block a current path of a current which flows from the shaft 55*a* into the non-sheet passing area 13 in the shortest path. Meanwhile, regarding the concave portions Sal located on a more center side of the sheet passing area (namely, a more inner side than the end portion of the transfer material P) than the end portion of the transfer material P, the concave portion located closer to the center of the sheet passing area is formed to have a narrower width in order to secure paths Ig through which the current necessary for the transfer property of a toner image at the end portion of the transfer material P flows.

Further, the concave portion 5a1 is provided from the end portion on the sheet passing area side of a first contact portion 5a2 between the shaft 55*a* and the elastic portion 55*b* in the first region Re to a position corresponding to 15 mm inside from the end portion of the A4 size transfer material P toward the center side of the sheet passing area in the longitudinal direction. In other words, the concave portion 5a1 is extended by about 5 mm on the sheet passing area side in the longitudinal direction than the concave portion a1 according to the first exemplary embodiment, and, according to the configuration of the present exemplary embodiment, the transfer property of the toner image at the end portion of the transfer material P is ensured by providing the convex portions to secure the current flowing through the paths Ig. The first contact portion 5a2 serves as a pillar for supporting the elastic portion 55*b* at both ends of the shaft 55*a* and has a width of about 2 mm which is the same as that of the first contact portion a2 according to the first exemplary embodiment.

The non-sheet passing area 13 is an area in which the elastic portion 55*b* and the photosensitive drum 1 are in direct contact with each other. A minute current flowing from the first contact portion 5a2 through a path Ie and a minute current flowing through a path If by wrapping around from the inside of the sheet passing area of the A4 size transfer material P flow into the non-sheet passing area 13. A total amount of currents flowing into the non-sheet passing area 13 through the paths Ie and If is almost the same as that according to the first exemplary embodiment. More specifically, the width of the first contact portion 5a2 in the longitudinal direction is the same as the first contact portion a2, so that the amount of current flowing into the non-sheet passing area 13 through the path Ie is about the same as that according to the first exemplary embodiment. On the other hand, as for the amount of current flowing into the non-sheet passing area 13 through the path If, the current branched from the paths Ig excessively flows thereinto as compared with that according to the first exemplary embodiment, but, since the concave portion 5a1 is provided in a wide range up to 15 mm inside the sheet passing area, the total amount of current is about the same as that according to the first exemplary embodiment.

Table 3 indicates results of evaluating the levels of the end portion soiling of the transfer materials P in a case where the A4 size transfer materials P (basis weight 68 g/m$^2$) passed using the respective transfer rollers according to the present exemplary embodiment, the first comparative example, and the first exemplary embodiment. The conditions for performing the present evaluation were set to the same as the evaluation conditions according to the first exemplary embodiment.

TABLE 3

Evaluation results of end portion soiling in each configuration in a case where A4 size transfer materials p passed

| | Number of Passing Sheets Around 100 Sheets | Number of Passing Sheets Around 500 Sheets |
|---|---|---|
| First Comparative Example | B | C |
| First Exemplary Embodiment | A | A |
| Second Exemplary Embodiment | A | A |

As indicated in Table 3, according to the present exemplary embodiment, the end portion soiling at a visible level could not be confirmed, and the evaluation results were good as with the first exemplary embodiment. As described above, the concave portion Sal according to the present exemplary embodiment has the shape different from that according to the first exemplary embodiment. However, the voids 70 are formed between the shaft 55*a* and the elastic portion 55*b*, and thus the current flowing into the non-sheet passing area 13 can be suppressed, and occurrence of the end portion soiling can be suppressed to the same extent as in the first exemplary embodiment.

According to the present exemplary embodiment, the concave portions Sal and the convex portions are alternately divided and formed with a relatively narrow width in the longitudinal direction of the transfer roller 55, so that the elastic portion 55*b* can be suppressed from largely bending even in the configuration in which a pressure for urging the transfer roller 55 toward the photosensitive drum 1 is high. Accordingly, the voids 70 formed between the shaft 55*a* and the elastic portion 55*b* can be stably secured. Accordingly, even in the configuration in which the pressure for urging the transfer roller 55 is high, the current concentration in the non-sheet passing area 13 can be reduced, and occurrence of the end portion soiling can be more effectively suppressed with respect to the configuration according to the first exemplary embodiment.

The above-described functions and effects obtained according to the present exemplary embodiment are not limited to a case in which the pressure for urging the transfer roller 55 is high and can be exerted under conditions in which the elastic portion 55*b* is easily bent, and there is a concern that the voids 70 may be crushed, for example, in a case where hardness of the elastic portion 55*b* is low or a thickness thereof is small.

The transfer roller 55 according to the present exemplary embodiment can also be obtained by press-fitting the shaft 55*a* on which the concave portions Sal are formed, into a tube-shaped elastic portion 55*b*, so that the transfer roller 55 can be easily obtained without complicating the manufacturing process.

Figure 10:
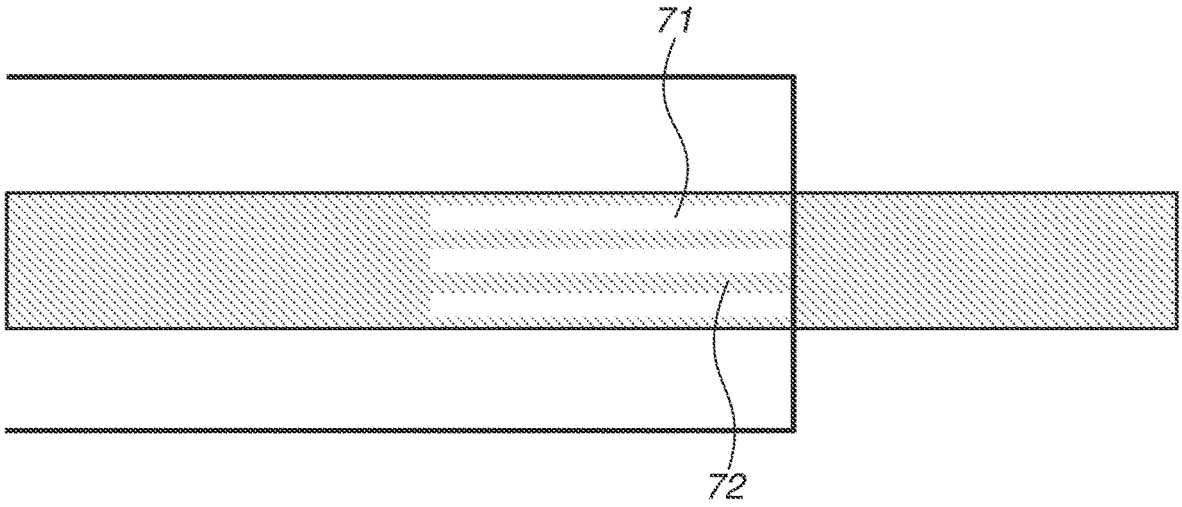
FIG. 10 is a schematic diagram of a modification of a transfer roller.
Figure 11:
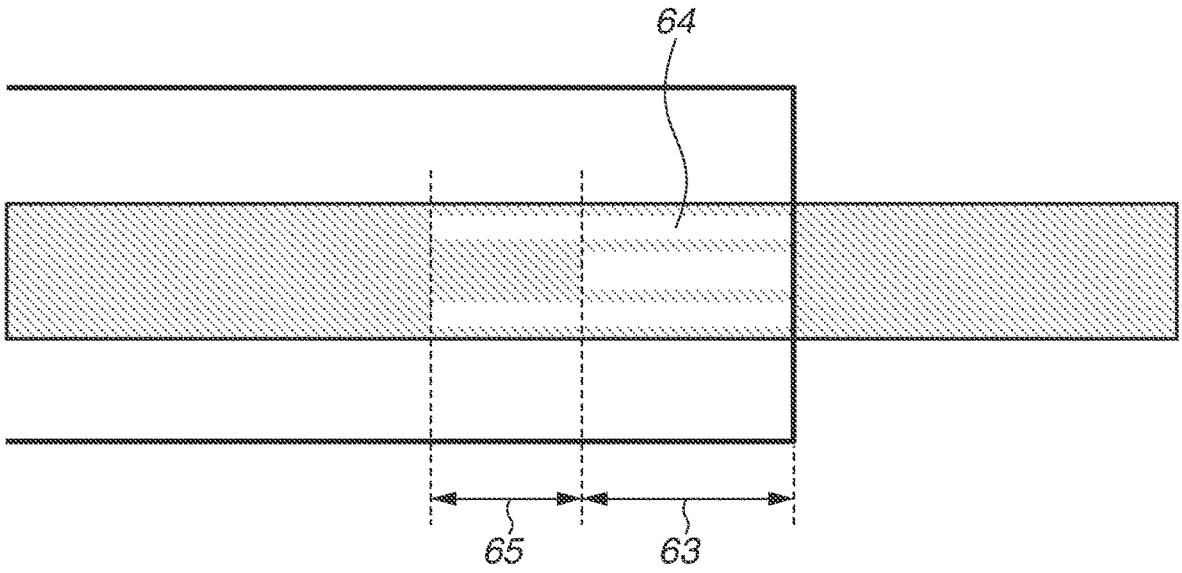
FIG. 11 is a schematic diagram of a modification of a transfer roller.

According to the first and the second exemplary embodiments, the configuration is described in which a concave portion which has a ring shape in a circumferential direction of the shaft and is concaved in a radial direction of the shaft is provided. However, the shape of the concave portion to be provided on the shaft is not limited to the one according to the above-described exemplary embodiments. For example, the configuration of the concave portion as illustrated in FIGS. 10 and 11 may be adopted as long as the configuration can suppress at least the current flowing into the non-sheet passing area 13. FIGS. 10 and 11 are schematic diagrams of modifications of the concave portion.

As illustrated in FIG. 10, a knurled groove extending in the longitudinal direction which is obtained by alternately dividing a concave portion 71 and a convex portion 72 in the circumferential direction may be provided as a concave portion. In addition, even in a case where a groove having a punch shape, a mesh shape, or a spiral shape, which is not illustrated, is provided, functions and effects similar to those according to the present exemplary embodiment can be obtained. Further, as illustrated in FIG. 11, a plurality of knurled grooves having different lengths may be mixed in the circumferential direction. In the configuration illustrated in FIG. 11, it is desirable to increase a proportion of a concave portion 64 to be formed on the shaft in order to suppress an excessive current concentration in a position corresponding to a non-sheet passing area 63 on the end portion in the longitudinal direction. Meanwhile, it is desirable to reduce the proportion of the concave portion 64 to be formed on the shaft in order to ensure the transfer property of the toner image at the end portion of the transfer material P at a position corresponding to a sheet passing area 65 on an inner side in the longitudinal direction According to the first exemplary embodiment, the configuration is described in which the concave portion a1 is provided in the shaft 5*a* of the transfer roller 5, and the void 10 having a predetermined range is formed between the shaft 5*a* and the elastic portion 5*b*. In contrast, according to a third exemplary embodiment, a configuration is described in which a high resistance member 79 is provided to a concave portion 78 of a shaft 76. In the following description, the portions common to those according to the first exemplary embodiment are denoted by the same reference numerals, and the descriptions thereof are omitted.

Figure 12:
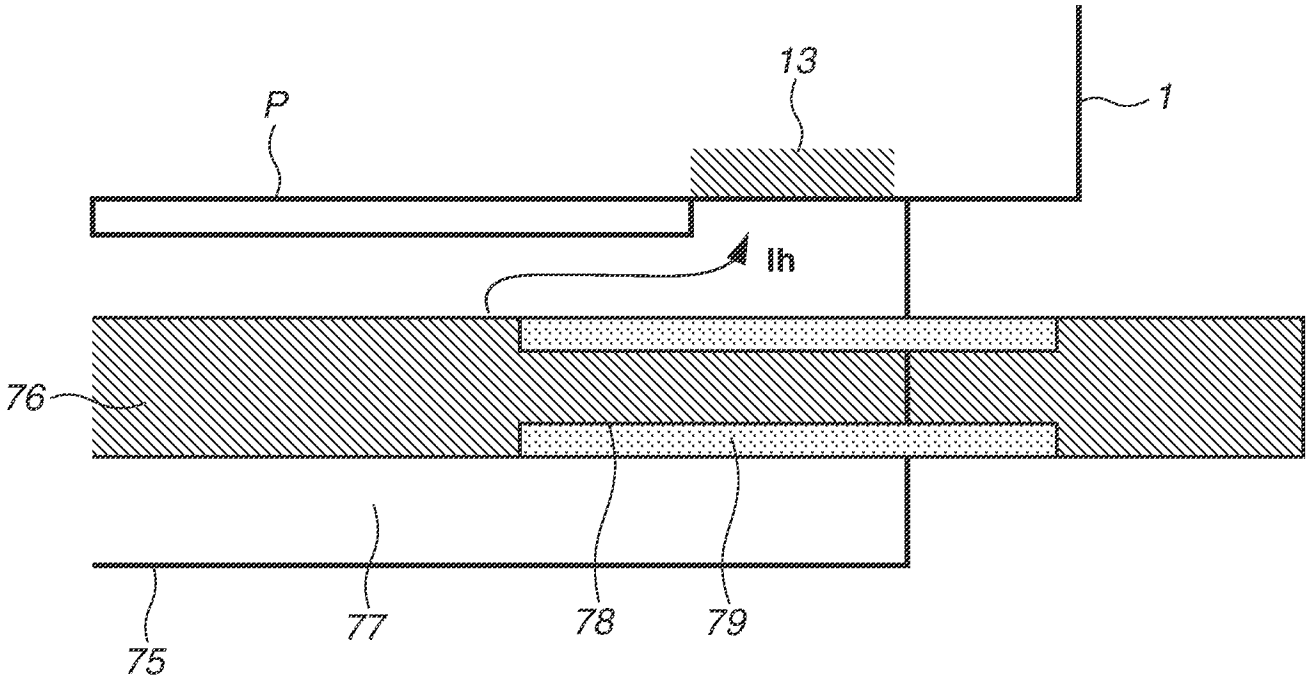
FIG. 12 is a schematic diagram of a configuration of a transfer roller and a path of a current flowing to a non-sheet passing area according to a third exemplary embodiment.

FIG. 12 is a schematic diagram of a transfer roller 75 according to the present exemplary embodiment enlarged on one side in the longitudinal direction. The transfer roller 75 is configured with a conductive shaft 76 surrounded by a tube-shaped elastic portion 77. The shaft 76 is made of a metal material such as SUS, a conductive resin, or the like, has the concave portion 78 on the end portion in the longitudinal direction, and is provided with the high resistance member 79 between the concave portion 78 and the elastic portion 77. It is desirable that the high resistance member 79 is provided up to about 10 mm inside in the longitudinal direction of an A4 size sheet in order to suppress the current concentration in the non-sheet passing area 13. It is more desirable that the high resistance member 79 is provided up to the inside of the sheet passing area in the longitudinal direction as much as possible within a range in which end portion transfer property has a sufficient margin. Meanwhile, with respect to the outside in the longitudinal direction, the high resistance member 79 may be formed on the outside of an end surface of the elastic portion 77 in the longitudinal direction as long as the high resistance member 79 does not interfere with a contact point between an end surface of the shaft 76 and a non-illustrated bearing. A resistance value of the high resistance member 79 is set to 100 times or more, desirably 10,000 times or more a resistance value of the semiconductive member. The high resistance member 79 is formed by fixing a high resistance resin or the like to the concave portion 78 of the shaft 76 mechanically or with an adhesive so as not to generate a level difference in a radial direction from an outer circumferential surface the shaft 76.

As described above, in the configuration according to the present exemplary embodiment, the high resistance member 79 is formed on the outside in the longitudinal direction of an A4 size area, and thus a current path of a current flowing from the shaft 76 to the non-sheet passing area 13 in the shortest path is blocked. Further, there is no support member which supports a void as in the first and the second exemplary embodiments, so that there is no current flowing from the support member at the end portion of the shaft 76. Only the current which wraps around from the inside in the longitudinal direction of the sheet passing area through a path 111 indicated by an arrow in FIG. 12 flows into the non-sheet passing area 13. Therefore, the effect equal to or higher than that according to the first exemplary embodiment can be obtained with respect to the end portion soiling caused by the transfer memory.

Further, the configuration according to the present exemplary embodiment does not include a void due to a concave portion and thus does not need to assume bending of the elastic portion and crushing of the void accompanying the concave portion as described in the second exemplary embodiment. Therefore, an effect equal to or higher than that according to the second exemplary embodiment can be obtained even for the end portion soiling caused by the transfer memory in a case where a pressure for urging the transfer roller is high as an evaluation condition according to the second exemplary embodiment.

According to the present exemplary embodiment, the example is described in which a single and wide concave portion is provided on the shaft, and the high resistance member is provided in the concave portion. However, the shape of the concave portion according to the third exemplary embodiment is not limited to that according to the above-described exemplary embodiments. For example, the transfer property of the toner image at the end portion of the transfer material P may be optimized by providing the high resistance member in the concave portions divided in the longitudinal direction as illustrated in FIG. 9.

According to the present disclosure, a form of a contact type transfer member can be provided which is used in an image forming apparatus and is able to suppress occurrence of soiling in an end portion in a width direction of a transfer material.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-171283, filed Oct. 9, 2020, which is hereby incorporated by reference herein in its entirety.

What is claimed is:

1. An image forming apparatus comprising:

an image bearing member configured to bear a toner image; and a transfer member configured to transfer the toner image borne by the image bearing member to a transfer material at a transfer portion which faces the image bearing member, the transfer member comprising a rotatable conductive shaft and an elastic portion which covers a periphery of the shaft, wherein, the shaft includes a first contact portion and a second contact portion, wherein, when the shaft is viewed from a direction orthogonal to a rotation axis direction of the shaft, the first contact portion is in contact with the elastic portion at an area from an end toward a center of the elastic portion in the rotation axis direction and the second contact portion is in contact with the elastic portion at an area closer to a center of the transfer portion than the first contact portion in the rotation axis direction, wherein a length of an A4-sized transfer material sandwiched by the transfer member and the image bearing member at the transfer portion is shorter than a length of the elastic portion in the rotation axis direction, wherein the first contact portion is provided to be closer to the end of the elastic portion than the end of the A4-sized transfer material, wherein the transfer member includes a void between the first contact portion and the second contact portion in the rotation axis direction, wherein the void is arranged to extend to an area closer to the center of the transfer portion than the end of the A4-sized transfer material, and wherein an inner circumferential surface of the elastic portion is supported by the first contact portion at the end of the elastic portion, and an end surface of the elastic portion in the rotation axis direction overlaps a region of the shaft where the void is not formed.

2. The image forming apparatus according to claim 1, wherein the shaft includes a concave portion formed between the first contact portion and the second contact portion which is concave in a radial direction of the shaft so that the shaft and the elastic portion do not come into contact with each other, and the void is formed by the concave portion.

3. The image forming apparatus according to claim 2, wherein the concave portion is formed continuously between the first contact portion and the second contact portion in the rotation axis direction.

4. The image forming apparatus according to claim 1, wherein the shaft includes a plurality of concave portions which are concave in a radial direction of the shaft between the first contact portion and the second contact portion in the rotation axis direction and the void includes a plurality of void portions formed by the plurality of concave portions.

5. The image forming apparatus according to claim 4, wherein, in a case where an area from the end portion of the A4-sized transfer material to an end portion of the elastic portion in the rotation axis direction is defined as a non-sheet passing area, and an area in which the A4-sized transfer material and the image bearing member come into contact with each other is defined as a sheet passing area, a width of a void portion in the non-sheet passing area is larger than a width of a void portion in the sheet passing area.

6. The image forming apparatus according to claim 1, wherein, in a case where an area from the end portion of the A4-sized transfer material to an end portion of the elastic portion in the rotation axis direction in which the image bearing member and the elastic portion come into contact with each other is defined as a non-sheet passing area, and an area in which the A4-sized transfer material and the image bearing member come into contact with each other is defined as a sheet passing area, the void is continuously formed in the non-sheet passing area.

7. The image forming apparatus according to claim 1, wherein, the shaft is viewed from the direction orthogonal to the rotation axis direction of the shaft, the void is arranged to be under the end of the A4-sized transfer material.

* * * * *